US007297231B2

(12) United States Patent
Goulet et al.

(10) Patent No.: US 7,297,231 B2
(45) Date of Patent: Nov. 20, 2007

(54) BINDERS CURABLE AT ROOM TEMPERATURE WITH LOW BLOCKING

(75) Inventors: Mike Thomas Goulet, Neenah, WI (US); Tracy Ho Mathews, Neenah, WI (US); Stacey Lynn Pomeroy, DePere, WI (US); Maurizio Tirimacco, Appleton, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 259 days.

(21) Appl. No.: 10/893,094

(22) Filed: Jul. 15, 2004

(65) Prior Publication Data

US 2006/0014884 A1 Jan. 19, 2006

(51) Int. Cl.
*D21H 19/00* (2006.01)
*C08G 83/00* (2006.01)

(52) U.S. Cl. ..... 162/168.1; 162/123; 162/158; 524/500

(58) Field of Classification Search ..... 162/168.1, 162/123, 158; 524/500
See application file for complete search history.

(56) References Cited

U.S. PATENT DOCUMENTS

| | | | | |
|---|---|---|---|---|
| 2,624,245 | A | 1/1953 | Cluett | |
| 3,011,545 | A | 12/1961 | Welsh et al. | |
| 3,017,317 | A | 1/1962 | Voigtman et al. | |
| 3,096,228 | A | 7/1963 | Day et al. | |
| 3,260,778 | A | 7/1966 | Walton | |
| 3,301,746 | A | 1/1967 | Sanford et al. | |
| 3,329,556 | A | 7/1967 | Mcfalls et al. | |
| 3,359,156 | A | 12/1967 | Freuler et al. | |
| 3,416,192 | A | 12/1968 | Packard | |
| 3,426,405 | A | 2/1969 | Walton | |
| 3,554,863 | A | 1/1971 | Hervey et al. | |
| 3,630,837 | A | 12/1971 | Freuler | |
| 3,660,338 | A | 5/1972 | Economou | |
| 3,686,151 | A | 8/1972 | Keim | |
| 3,700,623 | A | 10/1972 | Keim | |
| 3,772,076 | A | 11/1973 | Keim | |
| 3,821,068 | A | 6/1974 | Shaw | |
| 3,879,257 | A | 4/1975 | Gentile et al. | |
| 3,903,342 | A | 9/1975 | Roberts, Jr. | |
| 3,926,716 | A | 12/1975 | Bates | |
| 3,994,771 | A | 11/1976 | Morgan, Jr. et al. | |
| 4,000,237 | A | 12/1976 | Roberts, Jr. | |
| 4,072,557 | A | 2/1978 | Schiel | |
| 4,090,385 | A | 5/1978 | Packard | |
| 4,125,659 | A | 11/1978 | Klowak et al. | |
| 4,144,122 | A | 3/1979 | Emanuelsson et al. | |
| 4,158,594 | A | 6/1979 | Becker et al. | |
| 4,208,459 | A | 6/1980 | Becker et al. | |
| 4,326,000 | A | 4/1982 | Roberts, Jr. | |
| 4,351,699 | A | 9/1982 | Osborn, III | |
| 4,440,597 | A | 4/1984 | Wells et al. | |
| 4,442,883 | A | 4/1984 | Yamakami et al. | |
| 4,483,332 | A | 11/1984 | Rind | |
| 4,507,173 | A | 3/1985 | Klowak et al. | |
| 4,528,239 | A | 7/1985 | Trokhan | |
| 4,529,480 | A | 7/1985 | Trokhan | |
| 4,529,489 | A | 7/1985 | Mcdonald et al. | |
| 4,610,743 | A * | 9/1986 | Salmeen et al. | 156/183 |
| 4,637,859 | A | 1/1987 | Trokhan | |
| 4,710,374 | A | 12/1987 | Grollier et al. | |
| 4,785,030 | A | 11/1988 | Noda et al. | |
| 4,822,453 | A | 4/1989 | Dean et al. | |
| 4,859,527 | A | 8/1989 | Distefano | |
| 4,891,249 | A | 1/1990 | Mcintyre | |
| 4,919,877 | A | 4/1990 | Parsons et al. | |
| 4,944,960 | A | 7/1990 | Sundholm et al. | |
| 4,949,668 | A | 8/1990 | Heindel et al. | |
| 4,996,091 | A | 2/1991 | Mcintyre | |
| 5,124,188 | A | 6/1992 | Roe et al. | |
| 5,129,988 | A | 7/1992 | Farrington, Jr. | |
| 5,143,776 | A | 9/1992 | Givens | |
| 5,196,470 | A | 3/1993 | Anderson et al. | |
| 5,200,036 | A | 4/1993 | Noda | |
| 5,264,468 | A | 11/1993 | Miyahara | |
| 5,312,863 | A | 5/1994 | Van Rheenen et al. | |

(Continued)

FOREIGN PATENT DOCUMENTS

DE 34 41 883 A1 5/1986

(Continued)

OTHER PUBLICATIONS

American Society for Testing Materials (ASTM) Designation: D1544-98, "Standard Test Method for Color of Transparent Liquids (Gardner Color Scale)," pp. 1-2, published Sep. 1998.

American Society for Testing Materials (ASTM) Designation: D5170-98, "Standard Test Method for Peel Strength ("T" Method) of Hook and Loop Touch Fasteners," pp. 702-704, published Mar. 1999.

TAPPI Official Test Method T 402 om-93, "Standard Conditioning and Testing Atmospheres For Paper, Board, Pulp Handsheets, and Related Products," published by the TAPPI Press, Atlanta, Georgia, revised 1993, pp. 1-3.

TAPPI Official Test Method T 411 om-89, "Thickness (Caliper) of Paper, Paperboard, and Combined Board," published by the TAPPI Press, Atlanta, Georgia, revised 1989, pp. 1-3.

(Continued)

*Primary Examiner*—Steven P. Griffin
*Assistant Examiner*—Dennis R. Cordray
(74) *Attorney, Agent, or Firm*—Gregory E. Croft

(57) ABSTRACT

Topically-applied binder materials for imparting wet strength to soft, absorbent paper sheets, such as are useful as household paper towels and the like, include an azetidinium-reactive polymer, such as a carboxyl-functional polymer, an azetidinium-functional polymer and, optionally, a component useful for reducing sheet-to-sheet adhesion (blocking) in the product. These binder materials can be cured at ambient temperature over a period of days and do not impart objectionable odor to final product when wetted.

12 Claims, 1 Drawing Sheet

U.S. PATENT DOCUMENTS 5,334,289 A 8/1994 Trokhan et al.
5,342,875 A 8/1994 Noda
5,366,785 A 11/1994 Sawdai
5,399,412 A 3/1995 Sudall et al.
5,429,686 A 7/1995 Chiu et al.
5,443,691 A 8/1995 Phan et al.
5,484,825 A 1/1996 Dick et al.
5,494,554 A 2/1996 Edwards et al.
5,529,664 A 6/1996 Trokhan et al.
5,529,665 A 6/1996 Kaun
5,547,710 A 8/1996 Satgurunathan et al.
5,556,509 A 9/1996 Trokhan et al.
5,575,891 A 11/1996 Trokhan et al.
5,593,545 A 1/1997 Rugowski et al.
5,607,551 A 3/1997 Farrington, Jr. et al.
5,610,215 A 3/1997 Nonweiler et al.
5,614,061 A 3/1997 Van Phan et al.
5,614,597 A * 3/1997 Bower ..... 525/430
5,637,194 A 6/1997 Ampulski et al.
5,656,132 A 8/1997 Farrington, Jr. et al.
5,667,636 A 9/1997 Engel et al.
5,672,248 A 9/1997 Wendt et al.
5,674,590 A 10/1997 Anderson et al.
5,679,222 A 10/1997 Rasch et al.
5,709,775 A 1/1998 Trokhan et al.
5,776,312 A 7/1998 Trokhan et al.
5,804,036 A 9/1998 Phan et al.
5,820,730 A 10/1998 Phan et al.
5,830,321 A 11/1998 Lindsay et al.
5,837,103 A 11/1998 Trokhan et al.
5,840,403 A 11/1998 Trokhan et al.
5,843,279 A 12/1998 Phan et al.
5,846,379 A 12/1998 Ampulski et al.
5,855,739 A 1/1999 Ampulski et al.
5,871,887 A 2/1999 Trokhan et al.
5,872,181 A 2/1999 Daniels et al.
5,877,239 A 3/1999 Craun et al.
5,885,418 A 3/1999 Anderson et al.
5,893,965 A 4/1999 Trokhan et al.
5,897,745 A 4/1999 Ampulski et al.
5,904,811 A 5/1999 Ampulski et al.
5,906,710 A 5/1999 Trokhan
5,908,889 A 6/1999 Bailey et al.
5,919,556 A 7/1999 Barnholtz
5,935,381 A 8/1999 Trokhan et al.
5,948,210 A 9/1999 Huston
5,989,682 A 11/1999 Anderson
5,990,377 A 11/1999 Chen et al.
6,017,417 A 1/2000 Wendt et al.
6,039,839 A 3/2000 Trokhan et al.
6,054,020 A 4/2000 Goulet et al.
6,059,928 A 5/2000 Van Luu et al.
6,063,449 A 5/2000 Koskinen et al.
6,083,346 A 7/2000 Hermans et al.
6,096,152 A 8/2000 Anderson et al.
6,096,169 A 8/2000 Hermans et al.
6,103,062 A 8/2000 Ampulski et al.
6,103,861 A * 8/2000 Staib et al. ..... 528/322
6,117,270 A 9/2000 Trokhan
6,117,492 A 9/2000 Goldstein et al.
6,120,642 A 9/2000 Lindsay et al.
6,126,784 A 10/2000 Ficke et al.
6,129,815 A 10/2000 Larson et al.
6,136,146 A 10/2000 Phan et al.
6,140,419 A 10/2000 Barglik-Chory et al.
6,143,135 A 11/2000 Hada et al.
6,179,961 B1 1/2001 Ficke et al.
6,187,137 B1 2/2001 Druecke et al.
6,187,139 B1 2/2001 Edwards et al.
6,187,140 B1 2/2001 Anderson et al.
6,193,847 B1 2/2001 Trokhan
6,197,154 B1 3/2001 Chen et al.
6,200,418 B1 3/2001 Oriaran et al.
6,200,419 B1 3/2001 Phan
6,228,216 B1 5/2001 Lindsay et al.
6,303,672 B1 10/2001 Papalos et al.
6,309,527 B1 10/2001 Broekhuis et al.
6,319,312 B1 11/2001 Luongo
6,387,989 B1 5/2002 Sulzbach et al.
6,395,957 B1 5/2002 Chen et al.
6,410,617 B1 6/2002 Sulzbach et al.
6,420,013 B1 7/2002 Vinson et al.
6,423,180 B1 7/2002 Behnke et al.
6,426,121 B1 7/2002 Goldstein et al.
6,462,159 B1 10/2002 Hamada et al.
6,464,831 B1 10/2002 Trokhan et al.
6,465,556 B1 10/2002 Pratt et al.
6,500,289 B2 * 12/2002 Merker et al. ..... 156/183
6,506,696 B2 1/2003 Goldstein et al.
6,506,821 B1 1/2003 Huver et al.
6,533,978 B1 3/2003 Wisneski et al.
6,534,151 B2 3/2003 Merker
6,534,177 B2 3/2003 Kohlhammer et al.
6,576,091 B1 6/2003 Cabell et al.
6,586,520 B1 * 7/2003 Canorro et al. ..... 524/514
6,607,630 B2 8/2003 Bartman et al.
6,608,237 B1 8/2003 Li et al.
6,610,173 B1 8/2003 Lindsay et al.
6,660,362 B1 12/2003 Lindsay et al.
6,727,004 B2 4/2004 Goulet et al.
6,846,383 B2 1/2005 Tirimacco
6,918,993 B2 7/2005 Tirimacco
6,936,316 B2 8/2005 Nigam et al.
7,045,026 B2 5/2006 Lorenz et al.
2001/0005529 A1 6/2001 Owens et al.
2002/0107495 A1 8/2002 Chen et al.
2002/0117280 A1 * 8/2002 Howle et al. ..... 162/166
2003/0079847 A1 5/2003 Howle et al.
2003/0121627 A1 7/2003 Hu et al.
2004/0007339 A1 1/2004 Tirimacco
2004/0018369 A1 1/2004 Goulet et al.
2004/0031578 A1 2/2004 Tirimacco
2004/0086726 A1 5/2004 Moline et al.
2004/0099388 A1 5/2004 Chen et al.
2004/0118531 A1 6/2004 Shannon et al.
2004/0118532 A1 6/2004 Sarbo et al.
2004/0118544 A1 6/2004 Tirimacco et al.
2004/0123963 A1 7/2004 Chen et al.
2004/0192136 A1 9/2004 Gusky et al.
2005/0004309 A1 1/2005 Gerst et al.
2005/0045292 A1 3/2005 Lindsay et al.
2005/0045293 A1 3/2005 Hermans et al.
2005/0045294 A1 3/2005 Goulet et al.
2005/0045295 A1 3/2005 Goulet et al.

FOREIGN PATENT DOCUMENTS

DE 43 05 727 A1 9/1994
EP 0 135 231 A1 3/1985
EP 0 140 404 A1 5/1985
EP 0 618 005 A2 10/1994
EP 0 662 542 A1 7/1995
EP 0 549 925 B1 8/1995
EP 0 694 578 A2 1/1996
EP 0 661 030 B1 7/2000
EP 1 180 559 A1 2/2002
EP 1 082 391 B1 6/2002
EP 1 316 432 A1 6/2003
GB 2 006 296 A 5/1979
GB 2 303 647 A 2/1997
WO WO 92/16681 A1 10/1992
WO WO 93/10732 A1 6/1993
WO WO 97/44528 A1 11/1997
WO WO 97/47227 A1 12/1997

| | | | |
|---|---|---|---|
| WO | WO 98/37274 | A1 | 8/1998 |
| WO | WO 98/55695 | A1 | 12/1998 |
| WO | WO 99/10597 | A1 | 3/1999 |
| WO | WO 99/34057 | A1 | 7/1999 |
| WO | WO 99/34060 | A1 | 7/1999 |
| WO | WO 00/08077 | A1 | 2/2000 |
| WO | WO 00/66835 | A1 | 11/2000 |
| WO | WO 01/02644 | A1 | 1/2001 |
| WO | WO 01/14641 | | 3/2001 |
| WO | WO 02/29154 | A2 | 4/2002 |
| WO | WO 02/41815 | A2 | 5/2002 |
| WO | WO 02/100032 | A1 | 12/2002 |
| WO | WO 2004/005039 | | 1/2004 |
| WO | WO 2004/009905 | A1 | 1/2004 |
| WO | WO 2004/037935 | A1 | 5/2004 |
| WO | WO 2005/021868 | | 3/2005 |

OTHER PUBLICATIONS

"Airflex 426 Emulsion," Air Products Polymers, L.P., 2-page brochure and Internet web page "http://airproducts.com/polymers/controlled/product_description.asp?intRegionalMarketSegment=55..." printed Jul. 1, 2003, 2 pages and 1 page Specifications.

Bhangale, Sunil M., "Epoxy Resins," Internet web page "http://sunilbhangale.tripod.com/epoxy.html", viewed and printed Jul. 29, 2003, pp. 1-4.

Blank, Werner J. et al., "Catalysis of the Epoxy-Carboxyl Reaction," *International Waterborn, High-Solids and Powder Coatings Symposium*, New Orleans, LA, Feb. 21-23, 2001, sponsored by the University of Southern Mississippi, Paper23_jct1.doc, printed Aug. 8, 2001, 18 pages.

Carey, Francise A., "Reactions of Epoxides," *Organic Chemistry 4e Carey Online Learning Center*, Chapter 16: Ethers, Epoxides and Sulfides, McGraw Hill, 2000, Internet web page, "http://www.mhhe.com/physsci/chemistry/carey/student/olc/ch16reactionsepoxides.html", viewed and printed Jul. 29, 2003, pp. 1-4.

Day, Dr. Richard, "Epoxy Resins," Internet web page, "http://www2.umist.ac.uk/material/teaching/year2/ml260/epoxy.doc", Feb. 26, 1998, viewed and printed Jul. 29, 2003, 10 pages.

DeVry, William E., "Latex Bonding Chemistry and Processes," *Nonwovens An Advanced Tutorial*, edited by Albin F. Turbak and Tyrone L. Vigo, TAPPI Press, Atlanta, GA, 1989, Chapter 5, pp. 51-69.

Donnelly, R.H. and Martti Kangas, "Dryad Technology—Implementing Spraying Technology in Paper and Board Manufacturing," *Paperi ia Puu—Paper and Timber*, vol. 83, No. 7, 2001, pp. 530-531.

Espy, Herbert H., "Alkaline-Curing Polymeric Amine-Epichlorohydrin Resins," *Wet-Strength Resins and Their Application*, edited by Lock L. Chan, Chapter 2, TAPPI Press, Atlanta, GA, 1994, pp. 14-44.

"Glycidylic Ethers," KEMI, National Chemicals Inspectorate, Sweden, Internet web page "http://www.kemi.se/kemamne_eng/glycidetrar_eng.htm", viewed and printed Jul. 29, 2003, pp. 1-2.

Moyer, W.W. Jr. and R.A. Stagg, "Miscellaneous Wet-Strength Agents," *Wet Strength in Paper and Paperboard*, TAPPI Monograph Series No. 29, Technical Association of the Pulp and Paper Industry, Mack Printing Company, Easton, PA, Chapter 8, 1965, pp. 105-125.

Oinonen, Hannu, "Metso Introduces New Coating Method: Spray for Light-Weight Coating," *Paperi ja Puu—Paper and Timber*, vol. 83, No. 7, 2001, pp. 526-528.

Sabia, A.J. and R.B. Metzler, "The Role of Silicones In Woven and Nonwoven Fabric Applications," *Advances in Nonwoven Technology—Tenth Technical Symposium*, Inda, Association of the Nonwoven Fabrics Industry, New York, Nov. 17-19, 1982, pp. 284-293.

Zhao, Yaqiu and Marek W. Urban, "Novel STY/nBA/GMA and STY/nBA/MAA Core—Shell Latex Blends: Film Formation, Particle Morphology, and Cross-Linking. 20. A Spectroscopic Study," *Macromolecules*, vol. 33, No. 22, 2000, pp. 8426-8434.

* cited by examiner

BINDERS CURABLE AT ROOM TEMPERATURE WITH LOW BLOCKING

BACKGROUND OF THE INVENTION

In the manufacture of certain bonded non-woven products, the use of topical binders to impart added strength to the final product is well known. An example of such a process is disclosed in U.S. Pat. No. 3,879,257 entitled "Absorbent Unitary Laminate-Like Fibrous Webs and Method for Producing Them" and issued Apr. 22, 1975 to Gentile et al., herein incorporated by reference. A problem associated with commercially available topical binders is that they require a highly elevated curing temperature to impart the desired strength, which in turn requires a curing oven or equivalent apparatus. These requirements add to the capital and manufacturing costs associated with the product. Also, some commercially available binders can emit hazardous air pollutants, such as formaldehyde, and the resulting product can exhibit an undesirable odor, particularly when wetted.

An improved binder system is disclosed in co-pending U.S. patent application Ser. No. 10/654,556 entitled "Low Odor Binders Curable at Room Temperature" filed Sep. 2, 2003 by Goulet et al. This binder system utilizes a mixture of an epoxy-reactive polymer and an epoxy-functional polymer. However, there remains a need to continually improve upon binder systems useful for the commercial production of paper towels, for example.

SUMMARY OF THE INVENTION

It now has been discovered that binder systems involving the reaction between an azetidinium-reactive polymer and an azetidinium-functional cross-linking polymer, when topically applied to a fibrous web such as a paper web, particularly a tissue or paper towel basesheet, can cure at ambient or low temperature without emitting formaldehyde and without imparting objectionable odors to the resulting product. Furthermore, such binder systems exhibit additional commercial advantages, such as viscosity stability, ease of use and low cost. Specifically, these binder systems retain a low viscosity value for a prolonged period of time (weeks) compared to other low temperature cure binder systems which significantly increase in viscosity after several hours, which makes application of the binder more difficult. Regarding ease of use, the azetidinium-functional cross-linking polymer does not require an activation step using a strong base as is needed with some other binder systems, which makes it easier to prepare, safer to handle and reduces overall binder cost. Further in regard to cost, azetidinium-functional cross-linking polymers can be considerably less expensive than epoxy-functional resins due to the existing large commercial market for azetidinium-functional cross-linking polymers as wet end additives for paper.

Without being bound by theory, it is hypothesized that during and after drying of the paper web, the functional moiety on the latex polymer reacts with the azetidinium-functional reactant to form a covalently bonded polymer network. Simultaneously, it is also hypothesized that the azetidinium-functional reactant can also react with carboxylic acid or other functional groups present on the fiber surface to provide additional strengthening of the basesheet. In addition, for poly(aminoamide)-epichlorohydrin resins, the azetidinium functional group can self-crosslink with amine functional groups present on the resin. In addition, and also simultaneously, for binder formulations that contain cross-linking additives designed to reduce blocking, these cross-linking additives are activated during the thermal drying step and can react both with the latex polymer and/or the nonwoven basesheet fibers to hold the polymer in place and reduce its ability to flow and increase blocking resistance characteristics of the bonded basesheet.

Hence, in one aspect the invention resides in an aqueous binder composition comprising an unreacted mixture of an azetidinium-reactive polymer and an azetidinium-functional cross-linking polymer, wherein the amount of the azetidinium-functional cross-linking polymer relative to the amount of the azetidinium-reactive polymer is from about 0.5 to about 25 dry weight percent on a solids basis.

In another aspect, the invention resides in a method of increasing the strength of a fibrous web comprising topically applying an aqueous binder composition to one or both outer surfaces of the web, wherein the binder composition comprises an unreacted mixture of an azetidinium-reactive polymer and an azetidinium-functional cross-linking polymer, wherein the amount of the azetidinium-functional cross-linking polymer relative to the amount of the azetidinium-reactive polymer is from about 0.5 to about 25 dry weight percent on a solids basis. The treated web can thereafter be optionally creped.

In another aspect, the invention resides in a fibrous web or sheet having first and second outer surfaces, wherein at least one outer surface comprises a topically-applied network of a cured binder composition resulting from the cross-linking reaction of an azetidinium-reactive polymer and an azetidinium-functional cross-linking polymer. As used herein, the term "network" is used to describe any binder pattern that serves to bond the sheet together. The pattern can be regular or irregular and can be continuous or discontinuous.

Products incorporating the fibrous webs of this invention can be single-ply or multi-ply (two, three, or more plies). The binder composition can be applied to one or more surfaces of the ply or plies within the product. For example, a single-ply product can have one or both surfaces treated with the binder composition. A two-ply product can have one or both outer surfaces treated with the binder composition and/or one or both inner surfaces treated with the binder composition. In the case of a two-ply product, it can be advantageous to have one or both binder-treated surfaces plied inwardly in order to expose the untreated surface(s) of the plies on the outside of the product for purposes of hand-feel or absorbency. When the binder is applied to the inner surfaces of a multi-ply product, the binder also provides a means of bonding the plies together. In such cases, mechanical bonding may not be required. In the case of a three-ply product, the same options are available. In addition, for example, it may be desirable to provide a center ply which is not treated with binder while the two outer plies are treated with binder as described above.

As used herein, a "polymer" is a macromolecule consisting of at least five monomer units. More particularly, the degree of polymerization, which is the number of monomer units in an average polymer unit for a given sample, can be about 10 or greater, more specifically about 30 or greater, more specifically about 50 or greater and still more specifically from about 10 to about 10,000.

Azetidinium-reactive polymers suitable for use in accordance with this invention are those polymers containing functional pendant groups that will react with azetidinium-functional molecules. Such reactive functional groups include carboxyl groups, amines and others. Particularly suitable azetidinium-reactive polymers include carboxyl-functional latex emulsion polymers. More particularly, carboxyl-functional latex emulsion polymers useful in accordance with this invention can comprise aqueous emulsion addition copolymerized unsaturated monomers, such as ethylenic monomers, polymerized in the presence of surfactants and initiators to produce emulsion-polymerized polymer particles. Unsaturated monomers contain carbon-to-carbon double bond unsaturation and generally include vinyl monomers, styrenic monomers, acrylic monomers, allylic monomers, acrylamide monomers, as well as carboxyl functional monomers. Vinyl monomers include vinyl esters such as vinyl acetate, vinyl propionate and similar vinyl lower alkyl esters, vinyl halides, vinyl aromatic hydrocarbons such as styrene and substituted styrenes, vinyl aliphatic monomers such as alpha olefins and conjugated dienes, and vinyl alkyl ethers such as methyl vinyl ether and similar vinyl lower alkyl ethers. Acrylic monomers include lower alkyl esters of acrylic or methacrylic acid having an alkyl ester chain from one to twelve carbon atoms as well as aromatic derivatives of acrylic and methacrylic acid. Useful acrylic monomers include, for instance, methyl, ethyl, butyl, and propyl acrylates and methacrylates, 2-ethyl hexyl acrylate and methacrylate, cyclohexyl, decyl, and isodecyl acrylates and methacrylates, and similar various acrylates and methacrylates.

In accordance with this invention, the carboxyl-functional latex emulsion polymer can contain copolymerized carboxyl-functional monomers such as acrylic and methacrylic acids, fumaric or maleic or similar unsaturated dicarboxylic acids, where the preferred carboxyl monomers are acrylic and methacrylic acid. The carboxyl-functional latex polymers comprise by weight from about 1% to about 50% copolymerized carboxyl monomers with the balance being other copolymerized ethylenic monomers. Preferred carboxyl-functional polymers include carboxylated vinyl acetate-ethylene terpolymer emulsions such as Airflex® 426 Emulsion, commercially available from Air Products Polymers, LP.

Suitable azetidinium-functional cross-linking polymers include polyamide-epichlorohydrin (PAE) resins, polyamide-polyamine-epichlorohydrin (PPE) resins, polydiallylamine-epichlorohydrin resins and other such resins generally produced via the reaction of an amine-functional polymer with an epihalohydrin. Many of these resins are described in the text "Wet Strength Resins and Their Applications", chapter 2, pages 14-44, TAPPI Press (1994), herein incorporated by reference.

The relative amounts of the azetidinium-reactive polymer and the azetidinium-functional cross-linking polymer will depend on the number of functional groups (degree of functional group substitution on molecule) present on each component. In general, it has been found that properties desirable for a disposable paper towel, for example, are achieved when the level of azetidinium-reactive polymer exceeds that of the azetidinium-functional cross-linking polymer on a dry solids basis. More specifically, on a dry solids basis, the amount of azetidinium-functional cross-linking polymer relative to the amount of azetidinium-reactive polymer can be from about 0.5 to about 25 weight percent, more specifically from about 1 to about 20 weight percent, still more specifically from about 2 to about 10 weight percent and still more specifically from about 5 to about 10 weight percent. Other applications may require higher levels of azetidinium-functional cross-linking polymer to achieve desired end use properties.

The surface area coverage of the binder composition on the fibrous web can be about 5 percent or greater, more specifically about 30 percent or greater, still more specifically from about 5 to about 90 percent, and still more specifically from about 20 to about 75 percent. The binder composition can be applied to one or both surfaces of the fibrous web by any suitable method such as printing, spraying, coating, foaming and the like.

Curing temperatures for the binder composition can be about 260° C. or less, more specifically about 120° C. or less, more specifically about 100° C. or less, more specifically about 40° C. or less, more specifically from about 10 to about 260° C. and still more specifically from about 20 to about 120° C. It will be appreciated that although the binder compositions of this invention can be cured at relatively low temperatures, the rate of curing can be accelerated at higher temperatures associated with curing conventional binders. However, such higher cure temperatures are not necessary with the binder compositions of this invention.

The "wet/dry ratio" for paper towels in accordance with this invention, which is the ratio of the CD wet tensile strength divided by the CD dry tensile strength for a given towel sample, can be about 0.40 or greater, more specifically from about 0.40 to about 0.70, and still more specifically from about 0.45 to about 0.65.

Although the binder compositions of this invention have very desirable anti-blocking characteristics, the binder compositions of this invention can optionally contain anti-blocking additives designed to modify the surface chemistry or characteristics of the binder film on the basesheet. Suitable anti-blocking additives include: 1) chemically reactive additives, such as multifunctional aldehydes, including glyoxal, glutaraldehyde and glyoxalated polyacrylamides designed to increase the level of crosslinking of the latex polymer immediately after drying the web; 2) non-reactive additives, such as silicones, waxes, oils, designed to modify the surface chemistry of at least one outer surface of the web to reduce blocking; and 3) soluble or insoluble crystals, such as sugars, talc, clay and the like, designed to reside on the surface of the binder film and thus reduce its propensity to cause blocking to an adjacent web surface. The amount of the anti-blocking additive in the binder composition, relative to the amount of azetidinium-reactive polymer on a weight percent solids basis, can be from about 1 to about 25 percent, more specifically from about 5 to about 20 percent and more specifically from about 10 to about 15 percent.

The effectiveness of an anti-blocking additive can be measured in accordance with the Blocking Test (hereinafter defined). Blocking test values for fibrous sheets, particularly paper towels, in accordance with this invention can be about 23 grams (force) or less, more specifically about 20 grams (force) or less, more specifically from about 1 to about 23 grams (force) and still more specifically from about 1 to about 15 grams (force).

TEST METHODS

As used herein, the "machine direction (MD) tensile strength" represents the peak load per sample width when a sample is pulled to rupture in the machine direction. In comparison, the cross-machine direction (CD) tensile strength represents the peak load per sample width when a sample is pulled to rupture in the cross-machine direction. Unless specified otherwise, tensile strengths are dry tensile strengths.

Samples for tensile strength testing are prepared by cutting a 3 inches (76.2 mm) wide×5 inches (127 mm) long strip in either the machine direction (MD) or cross-machine direction (CD) orientation using a JDC Precision Sample Cutter (Thwing-Albert Instrument Company, Philadelphia, Pa., Model No. JDC3-10, Serial No. 37333). The instrument used for measuring tensile strengths is an MTS Systems Sintech 11S, Serial No. 6233. The data acquisition software is MTS TestWorks® for Windows Ver. 3.10 (MTS Systems Corp., Research Triangle Park, N.C.). The load cell is selected from either a 50 Newton or 100 Newton maximum, depending on the strength of the sample being tested, such that the majority of peak load values fall between 10-90% of the load cell's full scale value. The gauge length between jaws is 4+/−0.04 inches (101.6+/−1 mm). The jaws are operated using pneumatic-action and are rubber coated. The minimum grip face width is 3 inches (76.2 mm), and the approximate height of a jaw is 0.5 inches (12.7 mm). The crosshead speed is 10+/−0.4 inches/min (254+/−1 mm/min), and the break sensitivity is set at 65%. The sample is placed in the jaws of the instrument, centered both vertically and horizontally. The test is then started and ends when the specimen breaks. The peak load is recorded as either the "MD tensile strength" or the "CD tensile strength" of the specimen depending on the sample being tested. At least six (6) representative specimens are tested for each product and the arithmetic average of all individual specimen tests is either the MD or CD tensile strength for the product.

Wet tensile strength measurements are measured in the same manner, but are only typically measured in the cross-machine direction of the sample. Prior to testing, the center portion of the CD sample strip is saturated with room temperature tap water immediately prior to loading the specimen into the tensile test equipment. CD wet tensile measurements can be made both immediately after the product is made and also after some time of natural aging of the product. For mimicking natural aging, experimental product samples are stored at ambient conditions of approximately 23° C. and 50% relative humidity for up to 15 days or more prior to testing so that the sample strength no longer increases with time. Following this natural aging step, the samples are individually wetted and tested. Alternatively, samples may be tested immediately after production with no additional aging time. For these samples, the tensile strips are artificially aged for 5 or 10 minutes in an oven at 105° C. prior to testing. Following this artificial aging step, the samples are individually wetted and tested. For measuring samples that have been made more than two weeks prior to testing, which are inherently naturally aged, such conditioning is not necessary.

Sample wetting is performed by first laying a single test strip onto a piece of blotter paper (Fiber Mark, Reliance Basis 120). A pad is then used to wet the sample strip prior to testing. The pad is a Scotch-Brite® brand (3M) general purpose commercial scrubbing pad. To prepare the pad for testing, a full-size pad is cut approximately 2.5 inches (63.5 mm) long by 4 inches (101.6 mm) wide. A piece of masking tape is wrapped around one of the 4 inch (101.6 mm) long edges. The taped side then becomes the "top" edge of the wetting pad. To wet a tensile strip, the tester holds the top edge of the pad and dips the bottom edge in approximately 0.25 inch (6.35 mm) of tap water located in a wetting pan. After the end of the pad has been saturated with water, the pad is then taken from the wetting pan and the excess water is removed from the pad by lightly tapping the wet edge three times on a wire mesh screen. The wet edge of the pad is then gently placed across the sample, parallel to the width of the sample, in the approximate center of the sample strip. The pad is held in place for approximately one second and then removed and placed back into the wetting pan. The wet sample is then immediately inserted into the tensile grips so the wetted area is approximately centered between the upper and lower grips. The test strip should be centered both horizontally and vertically between the grips. (It should be noted that if any of the wetted portion comes into contact with the grip faces, the specimen must be discarded and the jaws dried off before resuming testing.) The tensile test is then performed and the peak load recorded as the CD wet tensile strength of this specimen. As with the dry tensile tests, the characterization of a product is determined by the average of six representative sample measurements.

In addition to tensile strength, stretch is also reported by the MTS TestWorks® for Windows Ver. 3.10 program for each sample measured. Stretch is reported as a percentage and is defined as the ratio of the slack-corrected elongation of a specimen at the point it generates its peak load divided by the slack-corrected gage length.

As used herein, the Blocking Test value is determined by ASTM D 5170-98—Standard Test Method for Peel Strength ("T" Method) of Hook and Loop Touch Fasteners, but with the following exceptions in order to adapt the method from hook and loop testing to tissue testing (modified ASTM section numbers are shown in parenthesis):

(a) Replace all references to "hook and loop touch fasteners" with "blocked tissue samples".

(b) (Section 3.3) Only one calculation method is used, namely the "integrator average" or average force over the measured distance.

(c) (Section 4.1) No roller device is used.

(d) (Section 6. Specimen Preparation) Replace all contents with the following:

The level of blocking that will occur naturally over prolonged aging under pressure in a wound roll can be simulated by conditioning the samples in an oven under pressure. To artificially block samples, the 2 sheet specimens to be blocked together are cut to 76.2±1 mm (3±0.04 inches) in the cross direction by 177.8±25.4 mm (7±1 inch) in the machine direction. The specimens are then placed on a flat surface in an oven operating at 66° C. On top of the specimens is placed a lightweight polycarbonate plate. On top of the polycarbonate plate, centered on the sample strips, is placed an iron block weighing approximately 11,800 g and having a bottom face area of 10.2 cm×10.2 cm. The samples are stored in the oven under the applied weight for 1 hour. When the samples are removed from the oven, they are allowed to equilibrate under no additional weight for at least 4 hours in standard TAPPI conditions (25° C. and 50% relative humidity) prior to conducting the blocking test.

(e) (Section 8. Procedure) Replace all contents with the following:

"Separate the top and bottom sheet of the specimen along the CD (3 inch) edge. Peel back approximately 51 mm (2 inches) of the top and bottom sheets in the machine direction. Position the clamps of the tensile tester so they are 25.4±1 mm (1±0.04 inches) apart. Place the free ends of the specimen to be tested in the clamps of the tensile tester, with the specimen tail facing away from the frame. The point of specimen separation should be approximately centered between the clamps and aligned approximately parallel to the clamps. For the integrator calculation, set up the software to begin averaging after 25.4 mm (1 inch) of separation and end averaging after 88.9 mm (3.5 inches) of separation. The software should be set up to separate the sample over a total of 101.6 mm (4 inches)."

(f) (Section 9. Calculation) Omit all but 9.2.

(g) (Section 10. Report) Replace all contents with the following:

"Report the integrator average for each specimen."

(h) (Section 11.1) Replace all contents with the following:

"At least 5 specimens should be tested for a reliable sample average."

As used herein, "bulk" is calculated as the quotient of the caliper (hereinafter defined) of a product, expressed in microns, divided by the basis weight, expressed in grams per square meter. The resulting bulk of the product is expressed in cubic centimeters per gram. Caliper is measured as the total thickness of a stack of ten representative sheets of product and dividing the total thickness of the stack by ten, where each sheet within the stack is placed with the same side up. Caliper is measured in accordance with TAPPI test methods T402 "Standard Conditioning and Testing Atmosphere For Paper, Board, Pulp Handsheets and Related Products" and T411 om-89 "Thickness (caliper) of Paper, Paperboard, and Combined Board" with Note 3 for stacked sheets. The micrometer used for carrying out T411 om-89 is an Emveco 200-A Tissue Caliper Tester available from Emveco, Inc., Newberg, Oreg. The micrometer has a load of 2.00 kilo-Pascals (132 grams per square inch), a pressure foot area of 2500 square millimeters, a pressure foot diameter of 56.42 millimeters, a dwell time of 3 seconds and a lowering rate of 0.8 millimeters per second. After the caliper is measured, the top sheet of the stack of 10 is removed and the remaining sheets are used to determine the basis weight.

The products (single-ply or multi-ply) or sheets of this invention can have a bulk of about 11 cubic centimeters or greater per gram, more specifically about 12 cubic centimeters or greater per gram, more specifically about 13 cubic centimeters or greater per gram, more specifically from about 11 to about 20 cubic centimeters per gram, and still more specifically from about 12 to about 20 cubic centimeters per gram. Particular products of this invention include paper towels, bath tissue, facial tissue, table napkins, wipes and the like.

DETAILED DESCRIPTION OF THE DRAWING

Figure 1:
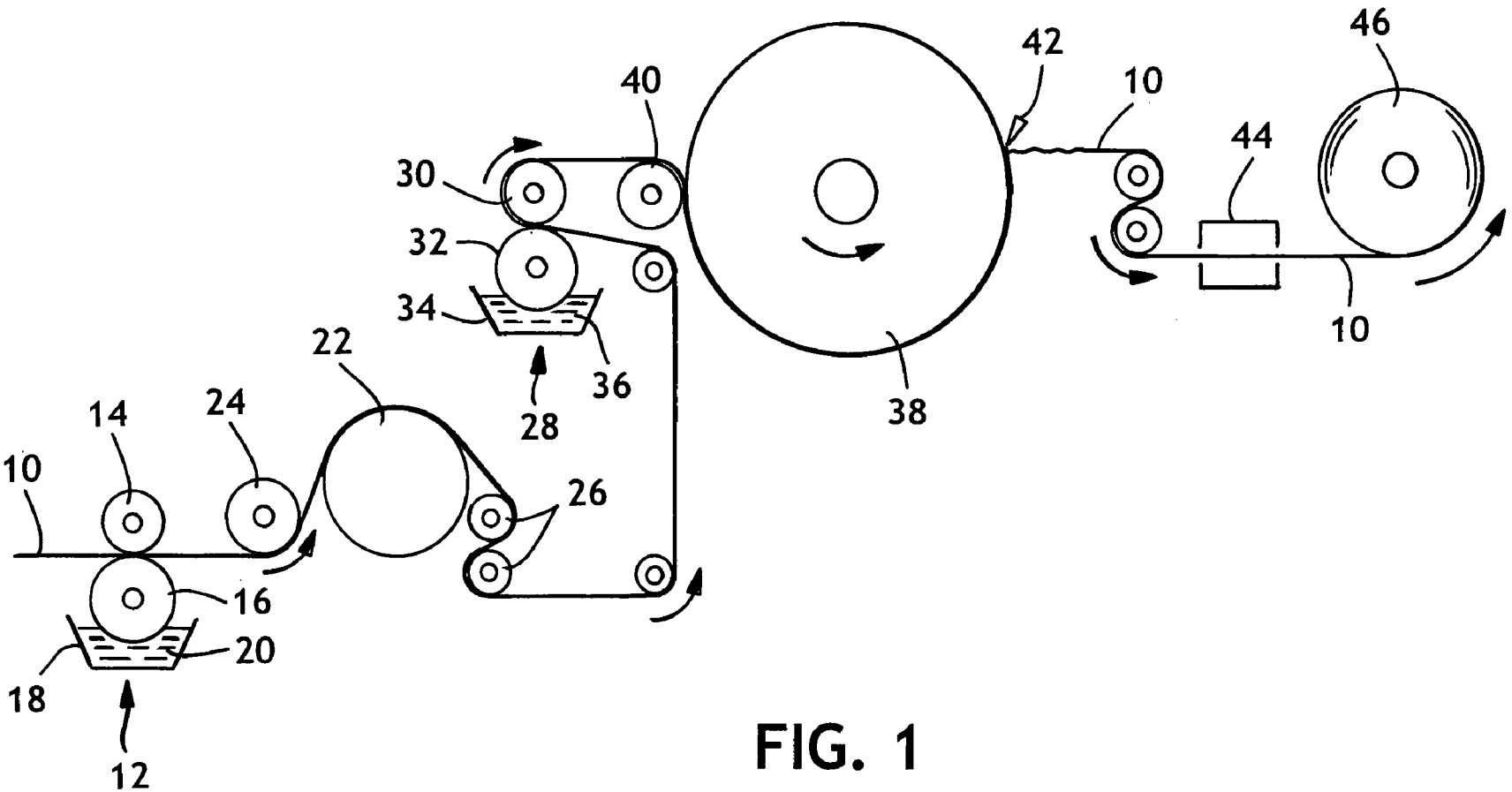
FIG. 1 is a schematic flow diagram of a process for topically applying a binder or binders to a paper web in accordance with this invention.

Referring to FIG. 1, shown is a method of applying a topical binder material to a previously-formed basesheet or web. The binder material can be applied to one or both sides of the web. For wet laid basesheets, at least one side of the web is thereafter creped. In general, for most applications, the basesheet or web will only be creped on one side after the binder materials are applied. It should be understood, however, that in some situations it may be desirable to crepe both sides of the web. Alternatively, nonwoven manufacturing processes which may not contain a creping step, such as air-laid papermaking processes, for example, may also utilize the low odor binder of the present invention for imparting structural integrity to the web. In such cases, post-treatment with topical binder material is optional.

Prior to applying the binder material to the web, the azetidinium-reactive polymer and the azetidinium-functional polymer can be mixed together along with any other binder formulation ingredients. Consequently, the binder material may be prepared in different ways, but a convenient method of preparation is to simply blend the azetidinium-functional polymer with the azetidinium-reactive polymer, water, defoamer (optional), pH control chemistry (optional) and anti-blocking additive (optional) and the resulting blended binder formulation is applied to the fibrous web, such as by printing, spraying, coating, foaming, size pressing or other means. Depending upon the stability of the resulting blended binder formulation, the elapsed time between blending of the binder composition and its application to the web can be less than a week, more specifically 48 hours or less, more specifically 24 hours or less, and still more specifically about 4 hours or less.

Returning to FIG. 1, a fibrous web 10 made according to any suitable wet-laying or air-laying process is passed through a first binder material application station 12. Station 12 includes a nip formed by a smooth rubber press roll 14 and a patterned rotogravure roll 16. Rotogravure roll 16 is in communication with a reservoir 18 containing a first binder material 20. The rotogravure roll applies the binder material to one side of web in a pre-selected pattern.

Web 10 is then contacted with a heated roll 22 after passing a roll 24. The heated roll 22 serves to at least partially dry the web. The heated roll can be heated to a temperature, for instance, up to about 121° C. and particularly from about 82° C. to about 104° C. In general, the web can be heated to a temperature sufficient to dry the web and evaporate any water. During the time the web is heated, some curing of the binder on the sheet may occur.

It should be understood, that the besides the heated roll 22, any suitable heating device can be used to dry the web. For example, in an alternative embodiment, the web can be placed in communication with a through-air dryer or an infra-red heater in order to dry the web. Other heating devices can include, for instance, any suitable convective oven, microwave oven or other suitable electromagnetic wave energy source.

From the heated roll 22, the web 10 can be advanced by pull rolls 26 to a second binder material application station generally 28. Station 28 includes a transfer roll 30 in contact with a rotogravure roll 32, which is in communication with a reservoir 34 containing a second binder material 36. Similar to station 12, second binder material 36 is applied to the opposite side of web 10 in a pre-selected pattern. Once the second binder material is applied, web 10 is adhered to a creping roll or drum 38 by a press roll 40. The web is carried on the surface of the creping roll for a distance and then removed therefrom by the action of a creping blade 42. The creping blade performs a controlled pattern creping operation on the second side of the paper web.

In accordance with the present invention, the second binder material 36 is selected such that the web 10 can be adhered to and creped from the creping drum 38. For example, in accordance with the present invention, the creping drum can be maintained at a temperature of between 66° C. and 121° C. Operation outside of this range is also possible. In one embodiment, for example, the creping drum 108 can be at 104° C. Alternatively, the creping drum need not be heated or only heated to a relatively low temperature.

Once creped, the paper web 10 is pulled through a drying station 44. Drying station 44 can include any form of a heating unit, such as an oven energized by infrared heat, microwave energy, hot air or the like. Alternatively, the drying station may comprise other drying methods such as photo-curing, UV-curing, corona discharge treatment, electron beam curing, curing with reactive gas, curing with heated air such as through-air heating or impingement jet heating, infrared heating, contact heating, inductive heating, microwave or RF heating, and the like. The dryer may also include a fan to blow air onto the moving web. Drying station 44 may be necessary in some applications to dry the web and/or cure the first and second binder materials.

Depending upon the binder materials selected, however, in other applications the drying station may not be needed.

The amount that the paper web is heated within the drying station 44 can depend upon the particular binder materials used, the amount of binder materials applied to the web, and the type of web used. In some applications, for instance, the paper web can be heated using a gas stream such as air at a temperature of about 265° C. in order to cure the binder materials. When using low cure temperature binder materials, on the other hand, the gas can be at a temperature lower than about 130° C. and particularly lower than about 120° C. In an alternative embodiment, the drying station 44 is not used to cure the binder material applied to the web. Instead, the drying station is used to dry the web and to drive off any water present in the web. In this embodiment, the web can be heated to temperatures sufficient to evaporate water, such as to a temperature of from about 90 to about 120° C. In other embodiments, room temperature air (20-40° C.) may be sufficient to dry the web. In still other embodiments, the drying station may be bypassed or removed from the process altogether.

Once passed through drying station, web 10 can be wound into a roll of material 46 for subsequent conversion into the final product. In other embodiments, the web may proceed directly into further converting operations to result in the final product without being wound into an intermediate roll.

EXAMPLES

Example 1

Epoxy-Functional Reactant Control

In general, a single-ply uncreped through-air-dried (UCTAD) sheet was produced generally as described in U.S. Pat. No. 5,593,545 issued Jan. 14, 1997 to Rugowski et al., herein incorporated by reference. After manufacture on the tissue machine, the UCTAD basesheet was printed on each side with a latex-based binder. The binder-treated sheet was adhered to the surface of a Yankee dryer to re-dry the sheet and thereafter the sheet was creped and wound onto a roll without any additional thermal curing. The resulting sheet was tested for physical properties after natural aging at room temperature (about 23° C.) and humidity (about 50% relative humidity).

More specifically, the basesheet was made from a stratified fiber furnish containing a center layer of fibers positioned between two outer layers of fibers. Both outer layers of the UCTAD basesheet contained 100% northern softwood kraft pulp and about 3.5 kilograms (kg)/metric ton (Mton) of dry fiber of a debonding agent, ProSoft® TQ1003 (Hercules, Inc.). Combined, the outer layers comprised 50% of the total fiber weight of the sheet (25% in each layer). The center layer, which comprised 50% of the total fiber weight of the sheet, was also comprised of northern softwood kraft pulp. The fibers in this layer were also treated with 3.5 kg/Mton of ProSoft® TQ1003 debonder.

The machine-chest furnish containing the chemical additives was diluted to approximately 0.2 percent consistency and delivered to a layered headbox. The forming fabric speed was approximately 445 meters per minute. The resulting web was then rush-transferred to a transfer fabric (Voith Fabrics, 807) traveling 15% slower than the forming fabric using a vacuum box to assist the transfer. At a second vacuum-assisted transfer, the web was transferred and wet-molded onto the throughdrying fabric (Voith Fabrics, t1203-8). The web was dried with a through-air-dryer resulting in a basesheet with an air-dry basis weight of approximately 45 grams per square meter (gsm).

The resulting sheet was fed to a gravure printing line, similar to that shown in FIG. 1, traveling at about 200 feet per minute (61 meters per minute) where a latex binder was printed onto the surface of the sheet. The first side of the sheet was printed with a bonding formulation using direct rotogravure printing. Then the printed web passed over a heated roll with a surface temperature of approximately 104° C. to evaporate water. Next, the second side of the sheet was printed with the bonding formulation using a second direct rotogravure printer. The sheet was then pressed against and doctored off a rotating drum, which had a surface temperature of approximately 104° C. Finally the sheet was cooled by passing room temperature air through the sheet prior to winding into a roll. The temperature of the wound roll was measured to be approximately 24° C.

The bonding formulation for this example was prepared as two separate mixtures, called the "latex" and "reactant". The "latex" material contained the epoxy-reactive polymer and the "reactant" was the epoxy-functional polymer. Each mixture was made up independently and then combined together prior to use. After the latex and reactant mixtures were combined, the appropriate amount of "thickener" (Natrosol solution) was added to adjust viscosity. The "latex" and "reactant" mixtures contained the following ingredients, listed in their order of addition.

| | |
|---|---|
| **Latex** | |
| 1. Airflex ® 426 (62.7% solids) | 8,555 g |
| 2. Defoamer (Nalco 7565) | 50 g |
| 3. Water | 1,530 g |
| 4. LiCl solution tracer (10% solids) | 50 g |
| **Reactant** | |
| 1. Kymene ® 2064 (20% solids) | 1,356 g |
| 2. Water | 2,000 g |
| 3. NaOH (10% solution) | 700 g |

When the NaOH had been added, the pH of the reactant mixture was approximately 12. After all reactant ingredients were added, the mixture was allowed to mix for at least 15 minutes prior to adding to the latex mixture.

Thickener

1. Natrosol 250MR, Hercules (2% solids) 600 g

After all ingredients had been added, the print fluid was allowed to mix for approximately 5-30 minutes prior to use in the gravure printing operation. For this bonding formulation, the weight percent ratio of epoxy-functional polymer based on carboxylic acid-functional polymer (epoxy-reactive polymer) was about 5%.

Lithium Chloride (LiCl) salt was added to the bonding formulation as a tracer to enable latex addition level to be analyzed using atomic absorption spectroscopy. An amount of LiCl no less than 250 parts per million (ppm) was added in the bonding formulation to ensure accurate detection measurement. The LiCl granules were dissolved in water and then added to the bonding formulation under agitation. After applying the bonding formulation to a basesheet, a sample of the bonding formulation and also a sample of the bonded sheet were collected for analysis.

The bonding formulation and bonded sheet were analyzed using atomic absorption spectroscopy to determine the percentage of latex add-on. First a calibration curve of absorbance vs. lithium concentration in ppm was created with standard LiCl solutions in water. The bonding formulations and bonded sheet were analyzed with atomic absorption spectroscopy after undergoing a series of combustion and water extraction steps to capture all lithium ions present in the respective samples. The weights of LiCl in the bonding formulation and bonded sheet samples were obtained by comparing their atomic absorbance values to the LiCl calibration curve. The concentration of LiCl in the bonding formulation was calculated, and then the weight of LiCl in each bonded sheet sample was converted into the amount of bonding formulation ($W_t$(BF)) applied to the sheet based on the LiCl content in the bonding formulation. Since the total solids content of the bonding formulation, $S_T$, and latex solids content, $S_L$, in the total solids are known, the percent of latex solids add-on (Latex %) can be calculated using the following equation:

$$\text{Latex } \% = \frac{W_t(BF) \times S_T \times S_L}{W_t(\text{Sample})} \times 100$$

where $W_t$(BF) is the weight of bonding formulation applied to the sheet in milligrams (mg), $W_t$(Sample) is the weight of bonded sheet in mg, $S_T$ is the weight percent content of total solids in the bonding formulation, and $S_L$ is the weight percent of latex solids in the total solids.

The viscosity of the print fluid was 120 cps, when measured at room temperature using a viscometer (Brookfield® Synchro-lectric viscometer Model RVT, Brookfield Engineering Laboratories Inc. Stoughton, Mass.) with a #1 spindle operating at 20 rpm. The oven-dry solids of the print fluid was 38 weight percent. The print fluid pH was 5.0.

Thereafter the print/print/creped sheet was removed from the roll and tested for basis weight, tensile strength and sheet blocking. Wet tensile testing was conducted after first artificially aging the sheet for 10 minutes in an oven operating at 105° C. Approximately 6% by weight Airflex® 426 was applied to the sheet.

Example 2

Invention

A single-ply bonded sheet was produced as described in Example 1, but using a different binder recipe. For this example, an azetidinium-functional reactant, Kymene® 557LX (Hercules Inc., Wilmington, Del.) was used. The ingredients of the "latex", "reactant" and "thickener" are listed below.

| | |
|---|---|
| **Latex** | |
| 1. Airflex ® 426 (62.7% solids) | 8,555 g |
| 2. Defoamer (Nalco 7565) | 54 g |
| 3. Water | 1,530 g |
| 4. LiCl solution tracer (10% solids) | 65 g |
| **Reactant** | |
| 1. Kymene ® 557LX (12.5% solids) | 1,356 g |
| 2. Water | 1,875 g |
| **Thickener** | |
| 1. Natrosol 250MR, Hercules (2% solids) | 700 g |

The reactant ingredients (Kymene and water) were added directly to the Latex mixture under agitation. After all ingredients had been added, the print fluid was allowed to mix for approximately 5-30 minutes prior to use in the gravure printing operation. For this bonding formulation, the weight percent ratio of azetidinium-functional polymer based on carboxylic acid-functional polymer was 3.2%.

The viscosity of the print fluid was 125 cps, when measured at room temperature using a viscometer (Brookfield® Synchro-lectric viscometer Model RVT, Brookfield Engineering Laboratories Inc. Stoughton, Mass.) with a #1 spindle operating at 20 rpm. The oven-dry solids of the print fluid was 38.2 weight percent. The print fluid pH was 3.7.

Thereafter the print/print/creped sheet was removed from the roll and tested for basis weight, tensile strength and sheet blocking. Wet tensile testing was conducted after first artificially aging the sheet for 10 minutes in an oven operating at 105° C. Approximately 6% by weight Airflex® 426 was applied to the sheet.

Example 3

Invention

A single-ply bonded sheet was produced as described in Example 2, but using a binder recipe which was designed to reduce blocking in the finished roll. The ingredients of the "latex", "reactant", "anti-blocking additive" and "thickener" are listed below.

| | |
|---|---|
| **Latex** | |
| 1. Airflex ® 426 (62.7% solids) | 6,920 g |
| 2. Defoamer (Nalco 7565) | 40 g |
| 3. Water | 5,485 g |
| 4. LiCl solution tracer (10% solids) | 40 g |
| **Reactant** | |
| 1. Kymene ® 557LX (12.5% solids) | 2,180 g |

The reactant was added directly to the latex mixture under agitation. After all ingredients had been added, the print fluid was allowed to mix for approximately 5-30 minutes.

The anti-blocking additive was added next, followed by the thickener to achieve desired viscosity.

| | |
|---|---|
| **Anti-Blocking Additive** | |
| 1. Glyoxal (40%) | 548 g |
| **Thickener** | |
| 1. Natrosol 250MR, Hercules (2% solids) | 1,010 g |

After all ingredients had been added, the print fluid was allowed to mix for approximately 5-30 minutes prior to use in the gravure printing operation. For this bonding formulation, the weight percent ratio of azetidinium-functional polymer based on carboxylic acid-functional polymer was 6.25% and the weight percent ratio of glyoxal based on carboxylic acid-functional polymer was about 5%. The viscosity of the print fluid was 82.5 cps, when measured at room temperature using a viscometer (Brookfield® Synchro-lectric viscometer Model RVT, Brookfield Engineering Laboratories Inc. Stoughton, Mass.) with a #1 spindle operating at 20 rpm. The print fluid pH was 3.5.

The resulting single-ply bonded sheet was tested for tensile strength and sheet blocking after 14 days of aging at room temperature conditions.

Example 4

Invention

A single-ply bonded sheet was produced as described in Example 2, but using a binder recipe which was designed to reduce blocking in the finished roll. The anti-blocking additives used in this example included glyoxal and a glyoxalated polyacrylamide (Parez® 631NC, Bayer Chemicals Corp.) The ingredients of the "latex", "reactant", "anti-blocking additives" and "thickener" are listed below.

| Latex | |
|---|---|
| 1. Airflex ® 426 (62.7% solids) | 6,920 g |
| 2. Defoamer (Nalco 7565) | 40 g |
| 3. Water | 3,670 g |
| 4. LiCl solution tracer (10% solids) | 40 g |
| Reactant | |
| 1. Kymene ® 557LX (12.5% solids) | 2,175 g |

The reactant was added directly to the latex mixture under agitation. After all ingredients had been added, the print fluid was allowed to mix for approximately 5-30 minutes.

The anti-blocking additives were added next, followed by the thickener to achieve desired viscosity.

| Anti-Blocking Additives | |
|---|---|
| 1. Glyoxal (40%) | 543 g |
| 2. Parez 631NC (6.0%) | 1,816 g |
| Thickener | |
| 1. Natrosol 250MR, Hercules (2% solids) | 220 g |

After all ingredients had been added, the print fluid was allowed to mix for approximately 5-30 minutes prior to use in the gravure printing operation. For this bonding formulation, the weight percent ratio of azetidinium-functional polymer based on carboxylic acid-functional polymer was 6.25% and the weight percent ratio of glyoxal and Parez 631NC based on carboxylic acid-functional polymer were 5% and 2.5%, respectively. The viscosity of the print fluid was 85 cps, when measured at room temperature using a viscometer (Brookfield® Synchro-lectric viscometer Model RVT, Brookfield Engineering Laboratories Inc. Stoughton, Mass.) with a #1 spindle operating at 20 rpm. The print fluid pH was 3.4. The latex binder addition was measured using atomic absorption. Approximately 5.6% by weight Airflex® 426 was applied to the sheet.

The resulting single-ply bonded sheet was tested for tensile strength and sheet blocking after 14 days of aging at room temperature conditions.

Example 5

Invention

A single-ply bonded sheet was produced as described in Example 2, but using a binder recipe which was designed to reduce blocking in the finished roll. The anti-blocking additives used in this example included glyoxal and a glyoxalated polyacrylamide (Parez® 631NC, Bayer Chemicals Corp.) The ingredients of the "latex", "reactant", "anti-blocking additives" and "thickener" are listed below.

| Latex | |
|---|---|
| 1. Airflex ® 426 (62.7% solids) | 6,920 g |
| 2. Defoamer (Nalco 7565) | 40 g |
| 3. Water | 2,000 g |
| 4. LiCl solution tracer (10% solids) | 40 g |
| Reactant | |
| 1. Kymene ® 557LX (12.5% solids) | 3,488 g |

The reactant was added directly to the latex mixture under agitation. After all ingredients had been added, the print fluid was allowed to mix for approximately 5-30 minutes.

The anti-blocking additives were added next. No thickener was added to this code.

| Anti-Blocking Additives | |
|---|---|
| 1. Glyoxal (40%) | 1,090 g |
| 2. Parez 631NC (6.0%) | 3,633 g |

After all ingredients had been added, the print fluid was allowed to mix for approximately 5-30 minutes prior to use in the gravure printing operation. For this bonding formulation, the weight percent ratio of azetidinium-functional polymer based on carboxylic acid-functional polymer was 10% and the weight percent ratio of glyoxal and Parez 631NC based on carboxylic acid-functional polymer were 10% and 5%, respectively. The viscosity of the print fluid was 120 cps, when measured at room temperature using a viscometer (Brookfield® Synchro-lectric viscometer Model RVT, Brookfield Engineering Laboratories Inc. Stoughton, Mass.) with a #1 spindle operating at 20 rpm. The print fluid pH was 3.5. The latex binder addition was approximately 6% by weight Airflex® 426 based on the finished sheet.

The resulting single-ply bonded sheet was tested for tensile strength and sheet blocking after 14 days of aging at room temperature conditions.

Example 6

Invention

A single-ply bonded sheet was produced as described in Example 2, but using a binder recipe which was designed to reduce blocking in the finished roll. The anti-blocking additives used in this example included glyoxal and a glyoxalated polyacrylamide (Parez® 631NC, Bayer Chemicals Corp.) The ingredients of the "latex", "reactant", "anti-blocking additives" and "thickener" are listed below.

| Latex | |
|---|---|
| 1. Airflex ® 426 (62.7% solids) | 6,920 g |
| 2. Defoamer (Nalco 7565) | 52 g |
| 3. Water | 3,153 g |
| 4. LiCl solution tracer (10% solids) | 42 g |
| Reactant | |
| 1. Kymene ® 557LX (12.5% solids) | 2,180 g |

The reactant was added directly to the latex mixture under agitation. After all ingredients had been added, the print fluid was allowed to mix for approximately 5-30 minutes.

The anti-blocking additives were added next. No thickener was added to this code.

| Anti-Blocking Additives | |
|---|---|
| 1. Glyoxal (40%) | 545 g |
| 2. Parez 631NC (6.0%) | 3,634 g |

After all ingredients had been added, the print fluid was allowed to mix for approximately 5-30 minutes prior to use in the gravure printing operation. For this bonding formulation, the weight percent ratio of azetidinium-functional polymer based on carboxylic acid-functional polymer was 6.25% and the weight percent ratio of glyoxal and Parez 631NC based on carboxylic acid-functional polymer were 5% and 5%, respectively. The viscosity of the print fluid was 90 cps, when measured at room temperature using a viscometer (Brookfield® Synchro-lectric viscometer Model RVT, Brookfield Engineering Laboratories Inc. Stoughton, Mass.) with a #1 spindle operating at 20 rpm. The print fluid pH was 3.6. The latex binder addition was approximately 6% by weight Airflex® 426 applied to the sheet.

The resulting single-ply bonded sheet was tested for tensile strength and sheet blocking after 14 days of aging at room temperature conditions.

Example 7

Invention with One Print Step

A single-ply UCTAD sheet was produced generally as described in Example 1. After manufacture on the tissue machine, the UCTAD basesheet was printed on one side with a latex-based binder. The binder-treated sheet was adhered to the surface of a Yankee dryer to re-dry the sheet and thereafter the sheet was creped and wound onto a roll without any additional thermal curing. The resulting sheet was tested for physical properties after natural aging at room temperature (about 23° C.) and humidity (about 50% relative humidity).

More specifically, the basesheet was made from a stratified fiber furnish containing a center layer of fibers positioned between two outer layers of fibers. Both outer layers of the UCTAD basesheet contained 100% northern softwood kraft pulp. One outer layer was treated with 8.0 kilograms (kg)/metric ton (Mton) of dry fiber of a debonding agent, ProSoft® TQ1003 (Hercules, Inc.) and the other outer layer was treated with 3.0 kg/Mton of Prosoft® TQ1003. Both outer layers were also treated with 5.0 kg/Mton of a wet strength agent, Kymene 557LX (Hercules, Inc.). Combined, the outer layers comprised 50% of the total fiber weight of the sheet (25% in each layer). The center layer, which comprised 50% of the total fiber weight of the sheet, was also comprised of northern softwood kraft pulp. The fibers in this layer were also treated with 8.0 kg/Mton of ProSoft® TQ1003 debonder.

The machine-chest furnish containing the chemical additives was diluted to approximately 0.2 percent consistency and delivered to a layered headbox. The forming fabric speed was approximately 445 meters per minute. The resulting web was then rush-transferred to a transfer fabric (Voith Fabrics, t1207-6) traveling 25% slower than the forming fabric using a vacuum box to assist the transfer. At a second vacuum-assisted transfer, the web was transferred and wet-molded onto the throughdrying fabric (Voith Fabrics, t1207-6). The web was dried with a through-air-dryer resulting in a basesheet with an air-dry basis weight of approximately 48 grams per square meter (gsm).

The resulting sheet was fed to a gravure printing line, similar to that shown in FIG. 1, traveling at about 1000 feet per minute (305 meters per minute) where a latex binder was printed onto one side of the sheet. The printed side of the sheet was then pressed against and doctored off a rotating drum, which had a surface temperature of approximately 84° C. Finally the sheet was wound onto a roll without any additional thermal curing. The temperature of the wound roll was measured to be approximately 36° C.

The bonding formulation for this example contained a "latex", "reactant", "anti-blocking additive" and "pH control chemistry", as listed below in their order of addition.

| | |
|---|---|
| **Latex** | |
| 1. Airflex ® 426 (63.36% solids) | 27,680 g |
| 2. Defoamer (Nalco 7565) | 173 g |
| 3. Water | 5,600 g |
| 4. LiCl solution tracer (10% solids) | 178 g |
| **Reactant** | |
| 1. Kymene ® 557LX (12.5% solids) | 8,770 g |
| **Anti-Blocking Additive** | |
| 1. Parez 631NC (6.0%) | 7,315 g |
| **pH Control Chemistry** | |
| 1. NaOH (10% solution) | 974 g |

When the NaOH had been added, the pH of the reactant mixture was approximately 6.

After all ingredients had been added, the print fluid was allowed to mix for approximately 5-30 minutes prior to use in the gravure printing operation. For this bonding formulation, the weight percent ratio of azetidinium-functional polymer based on carboxylic acid-functional polymer (azetidinium-reactive polymer) was about 6.25%.

The viscosity of the print fluid was 140 cps, when measured at room temperature using a viscometer (Brookfield® Synchro-lectric viscometer Model RVT, Brookfield Engineering Laboratories Inc. Stoughton, Mass.) with a #1 spindle operating at 20 rpm. The oven-dry solids of the print fluid was 38.4 weight percent. The print fluid pH was 6.0.

Thereafter the print/creped sheet was removed from the roll and tested for basis weight, tensile strength and sheet blocking. Wet tensile testing was conducted after first artificially aging the sheet for 5 minutes in an oven operating at 105° C. Approximately 6% by weight Airflex® 426 was applied to the sheet.

A summary of the results of the foregoing Examples 1-7 is set forth in Table 1 below:

TABLE 1

| Example | MD Tensile Strength (g/3") | MD Stretch (%) | CD Tensile Strength (g/3") | CD Stretch (%) | CD Wet Tensile Strength (g/3") | Wet/Dry Ratio | Blocking Test* (g) |
|---|---|---|---|---|---|---|---|
| 1 (Control) | 1818 | 42 | 1458 | 18 | 593 | 40% | 25 (estimated) |
| 2 | 1585 | 36 | 1248 | 17 | 591 | 47% | Not measured |
| 3 | 1213 | 40 | 1116 | 13 | 541 | 48% | 3.3 |
| 4 | 1377 | 40 | 1142 | 12 | 526 | 46% | 5.6 |
| 5 | 1326 | 39 | 1239 | 12 | 565 | 46% | 3.8 |
| 6 | 1465 | 42 | 1455 | 12 | 660 | 45% | 2.8 |
| 7 | 1394 | 32 | 966 | 22 | 629 | 65% | Not measured |

*blocking values were tested after conditioning samples in an oven at 66° C., under weight which produced 1.44 psi pressure, for 1 hour to simulate blocking in a parent roll.

The data in Table 1 demonstrates the ability of the inventive low cure temperature binder to produce paper with a high level of wet tensile strength, a high wet/dry tensile ratio and a low Blocking Test value.

In the interests of brevity and conciseness, any ranges of values set forth in this specification are to be construed as written description support for claims reciting any sub-ranges having endpoints which are whole number values within the specified range in question. By way of a hypothetical illustrative example, a disclosure in this specification of a range of 1-5 shall be considered to support claims to any of the following sub-ranges: 1-4; 1-3; 1-2; 2-5; 2-4; 2-3; 3-5; 3-4; and 4-5.

It will be appreciated that the foregoing examples, given for purposes of illustration, are not to be construed as limiting the scope of this invention, which is defined by the following claims and all equivalents thereto.

We claim:

1. A fibrous sheet having first and second outer surfaces, wherein at least one outer surface comprises a topically-applied network of a cured binder composition resulting from the cross-linking reaction of a carboxylated vinyl acetate-ethylene terpolymer, an azetidinium-functional cross-linking polymer and a chemically reactive multi-functional aldehyde anti-blocking additive, said sheet having a wet/dry ratio of from about 0.40 to about 0.70.

2. The fibrous sheet of claim 1 wherein the amount of the carboxylated vinyl acetate-ethylene terpolymer relative to the azetidinium-functional cross-linking polymer is from about 0.5 to about 25 weight percent on a solids basis.

3. The fibrous sheet of claim 1 wherein the amount of the carboxylated vinyl acetate-ethylene terpolymer relative to the azetidinium-functional cross-linking polymer is from about 1 to about 20 weight percent on a solids basis.

4. The fibrous sheet of claim 1 wherein the amount of the carboxylated vinyl acetate-ethylene terpolymer relative to the azetidinium-functional cross-linking polymer is from about 2 to about 10 weight percent on a solids basis.

5. The fibrous sheet of claim 1 wherein the amount of the carboxylated vinyl acetate-ethylene terpolymer relative to the azetidinium-functional cross-linking polymer is from about 5 to about 10 weight percent on a solids basis.

6. The sheet of claim 1 wherein the anti-blocking additive is glyoxal.

7. The sheet of claim 1 wherein the anti-blocking additive is glutaraldehyde.

8. The sheet of claim 1 wherein the anti-blocking additive is glyoxalated polyacrylamide.

9. The sheet of claim 1 wherein the azetidinium-functional cross-linking polymer is a polyamide-epichlorohydrin resin.

10. The sheet of claim 1 wherein the azetidinium-functional cross-linking polymer is a polyamide-polyamine-epichlorohydrin resin.

11. The sheet of claim 1 wherein the azetidinium-functional cross-linking polymer is a polydiallylamine-epichlorohydrin resin.

12. The sheet of claim 1 wherein the azetidinium-functional cross-linking polymer is a polyamide-epichlorohydrin resin and the anti-blocking additive is glyoxal.

* * * * *